US005201813A

United States Patent [19]

Ives et al.

[11] Patent Number: 5,201,813

[45] Date of Patent: Apr. 13, 1993

[54] ROLL MONITOR SLED DATA HANDLING SYSTEM

[75] Inventors: Kenneth D. Ives, Center Township, Porter County; Roy D. Egren, Valparaiso, both of Ind.; James J. Karaganis, Jr., Geneva, Ill.

[73] Assignee: Westinghouse Electric Corp., Pittsburgh, Pa.

[21] Appl. No.: 672,307

[22] Filed: Mar. 20, 1991

[51] Int. Cl.[5] ..... B22D 11/16

[52] U.S. Cl. ..... 164/451; 164/150; 33/645; 33/657

[58] Field of Search ..... 164/451, 150, 4.1, 154, 164/452; 33/286, 645, 657, 655, 544.4, 542

[56] References Cited

U.S. PATENT DOCUMENTS

| | | | |
|---|---|---|---|
| Re. 30,075 | 8/1979 | Gonos et al. | 33/143 L |
| 3,735,848 | 5/1973 | Bode, Jr. et al. | 193/35 R |
| 3,752,210 | 8/1973 | Gallucci et al. | 164/82 |
| 4,295,278 | 10/1981 | Gloor | 33/182 |
| 4,363,172 | 12/1982 | Ives | 33/174 Q |
| 4,903,750 | 2/1990 | Ives | 164/150 |

*Primary Examiner*—Richard K. Seidel
*Assistant Examiner*—Erik R. Puknys
*Attorney, Agent, or Firm*—G. H. Telfer

[57] ABSTRACT

A roll monitor sled data handling system comprising a roll monitor sled and an off-line data handling system. The roll monitor sled consists of a housing having mounted thereon sensors which measure the roll gap and the angle of the rolls. These sensors create analog signals which are converted to digital signals and transmitted to an on-board computer. The processed digital signals include digital signals corresponding to analog signals created when the sensors are in contact with the rolls. The computer processes the digital signals and transmits the processed data to a radio modem. The radio modem transmits the processed digital signals to the off-line data display system. The data display system comprises a receiver modem, a host computer, a digital to analog converter and a display and chart recorder. The selected data is displayed and/or recorded to give the user a "real-time indication" of the critical dimensions of the rolls in a continuous casting machine.

10 Claims, 7 Drawing Sheets

ROLL MONITOR SLED DATA HANDLING SYSTEM

BACKGROUND OF THE INVENTION

1. Field Of The Invention

This invention relates to a roll monitor sled which is used to locate improperly positioned or bent rolls in a continuous caster machine and more particularly to an improved system to handle the data from the roll monitor sled concerning the rolls of the continuous caster machine.

2. Background Information

A conventional curved or straight rack continuous caster machine includes a frame and a plurality of opposed rolls journalled in the frame for guiding and confining a casting as its core continues to solidify.

A curved roll-rack includes top and bottom rolls which guide a casting as its direction of travel changes from substantially vertical to horizontal. A curved roll-rack usually defines an arcuate path of travel of a radius of at least about 30 feet. The gap between the work-engaging faces of the roll-pairs depends on the thickness of the casting. Consequently a curved roll-rack is a massive mechanism, yet it is important that its rolls are all straight and positioned accurately. The work-engaging faces of the top and bottom rolls of each pair should lie accurately on two predetermined arcs. In either a straight or curved roll-rack the gaps between the work-engaging faces of each roll-pair should be equal within small tolerances. Any rolls which are bent or not positioned properly may either become overloaded and hence subject to early failure, or else they do no effectively confine the casting.

In most continuous-casting installations the gaps between roll faces are measured manually and the rolls are adjusted with shims only while the casting machine is down for scheduled maintenance, ideally about one turn a week. Measuring and adjusting the roll gaps manually are awkward operations, often done inaccurately and can lead to severe quality problems. An improperly gapped roll-pair may go unnoticed until the next scheduled maintenance unless an actual failure occurs.

U.S. Pat. No. Re. 30,075, discloses a method and apparatus for locating improperly positioned or bent rolls. The apparatus consists of a roll gap sled comprising a housing movable along the path of travel of a workpiece in the continuous caster, a plurality of gap sensors including heads carried by the housing to contact the work-engaging faces of the individual roll-pairs successively and transducer means connected with the heads to transmit signals representative of the measurement of the gaps between the work-engaging faces of each roll-pair contacted by the heads. The transmitted signals are sent to a recorder mounted on the sled for subsequent analysis to determine the roll gap. This patent also discloses means for measuring the angle of the successive roll-pairs.

U.S. Pat. No. 4,903,750, which is expressly incorporated by reference herein also discloses a roll gap sled. This sled has five gap sensors and two angle sensors. The sled bears against the rolls by means of "spring packs" which are provided on separate portions of the sled.

It is known to transmit the transducer output from the sensors to an analog to digital converter on-board the sled. All of the transducer output is digitized, and sent to an off-line host computer by a dumb radio link.

The digitized analog is then reconverted to analog for recording on a chart recorder.

One of the disadvantages with a dumb radio link are that *all* of the digitized analog is sent to the host computer, thus much extraneous data, such as when the sensors are between rolls in the continuous caster machine, is created. In addition, transmission quality can effect the data sent and received which can lead to errors in roll gap and angle measurement. Finally, current technology is limited to eight digital bits which is insufficient for angle resolution without additional instruments.

There remains a need for a roll gap sled with an improved data handling system. This roll gap sled should give information immediately concerning the roll gap measurements, angle measurements and peak detection and this information should be accurate and presented to the user in an easy to interpret fashion.

SUMMARY OF THE INVENTION

The present invention has met the above need. The system includes a roll monitor sled and data display system. The roll monitor sled consists of a housing having mounted thereon sensors which measure the roll gap and the angle of the rolls. These sensors create analog signals which are converted to digital signals and transmitted to an on-board computer. The computer processes the digital signals and transmits the processed data to a radio modem. The processed digital signals include digital signals corresponding to analog signals created when the sensors are in contact with the rolls. The radio modem transmits the processed digital signals to the off-line data display system. The data display system comprises a receiver modem, a host computer having a display, a digital to analog converter and a chart recorder. The selected data is displayed and/or recorded to give the user a "real-time indication" of the critical dimensions of the rolls in a continuous casting machine for cost effective operation.

BRIEF DESCRIPTION OF THE DRAWINGS

A full understanding of the invention can be gained from the following description of the preferred embodiment when used in conjunction with the accompanying drawings in which.

DESCRIPTION OF THE PREFERRED EMBODIMENT

Figures 1, 6:
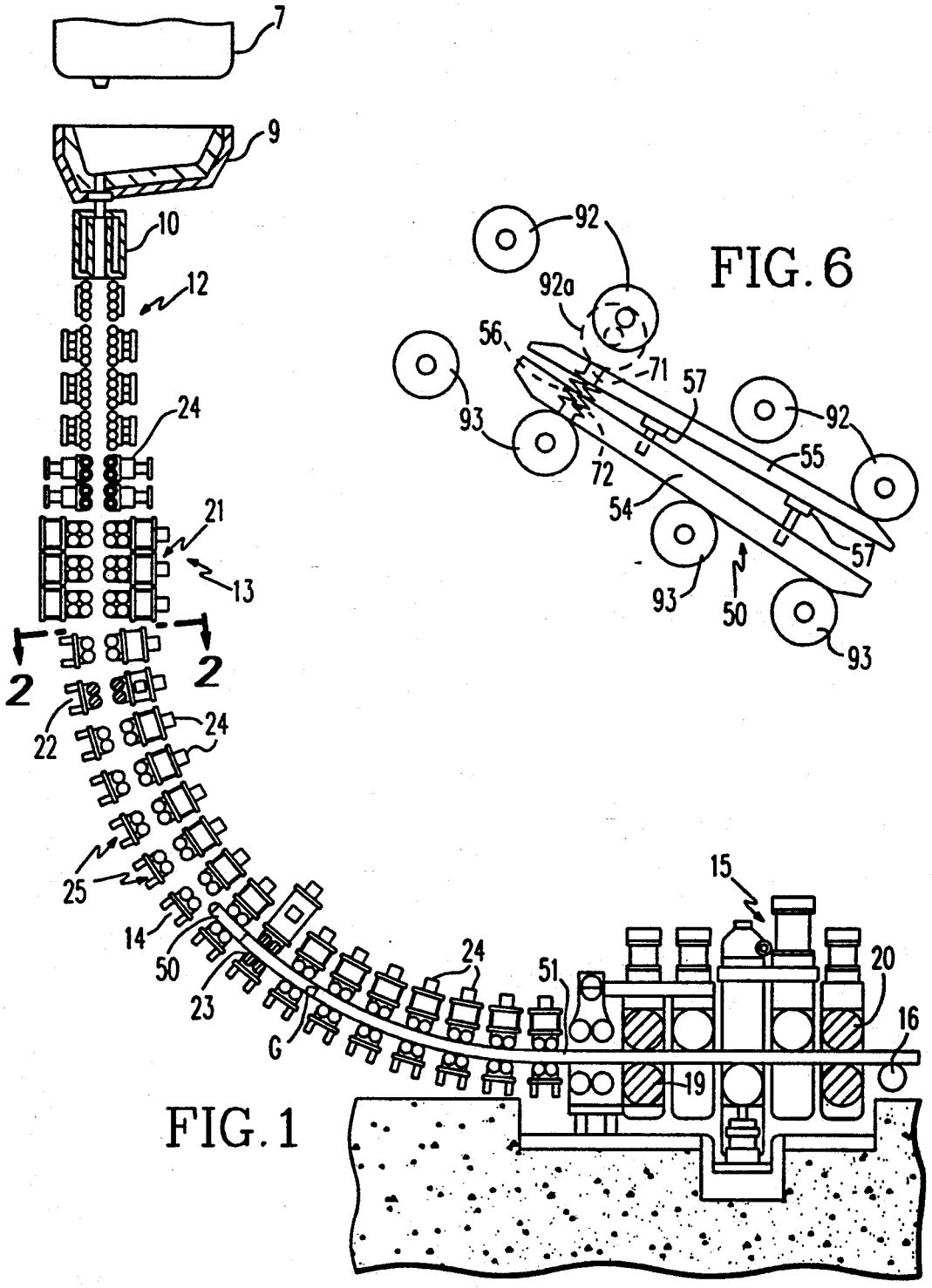
FIG. 1 is an elevational view of a continuous casting machine.
FIG. 6 is a diagrammatic elevational view illustrating the roll monitor device between opposed pairs of rolls.

As shown in FIG. 1 a continuous casting machine is disposed below a molten metal ladle 7 and a tundish 9.

The casting machine comprises an open ended, water-cooled, vertically oscillating mold 10, a guide roll rack 12, bending roll unit 13, a curved roll-rack 14, a straightener 15, and a run-out conveyor 16. Liquid metal (not shown) is teemed from the ladle 7 into the tundish 9 from where it is poured into the mold 10. A partially solidified casting (not shown) emerges continuously from the bottom of the mold and moves successively through the aforementioned components 12, 13, 14, 15, 16. The continuous casting or strand (not shown) is propelled by speed regulating drive rolls 19, 20 in the straightener and by power driven pinch rolls in auxiliary drives 21, 22, 23, which are located at spaced levels between the guide roll rack 12 and the straightener 15. The drives 21, 22, 23 are reversible and the other interposed rolls are idlers. The foregoing structure is similar to that set forth in U.S. Pat. Nos. 3,735,848, 3,752,210 and 3,939,568. The walls of the bending roll unit 13, the curved roll rack 14, and auxiliary drives 21, 22, 23 are arranged in top and bottom clusters 24, 25 of two rolls per cluster. The work-engaging faces of the rolls of the bottom cluster 25 are disposed in an arc. The gap between the working faces of the top and bottom roll pairs is indicated at "G" (FIG. 2).

Figure 2:
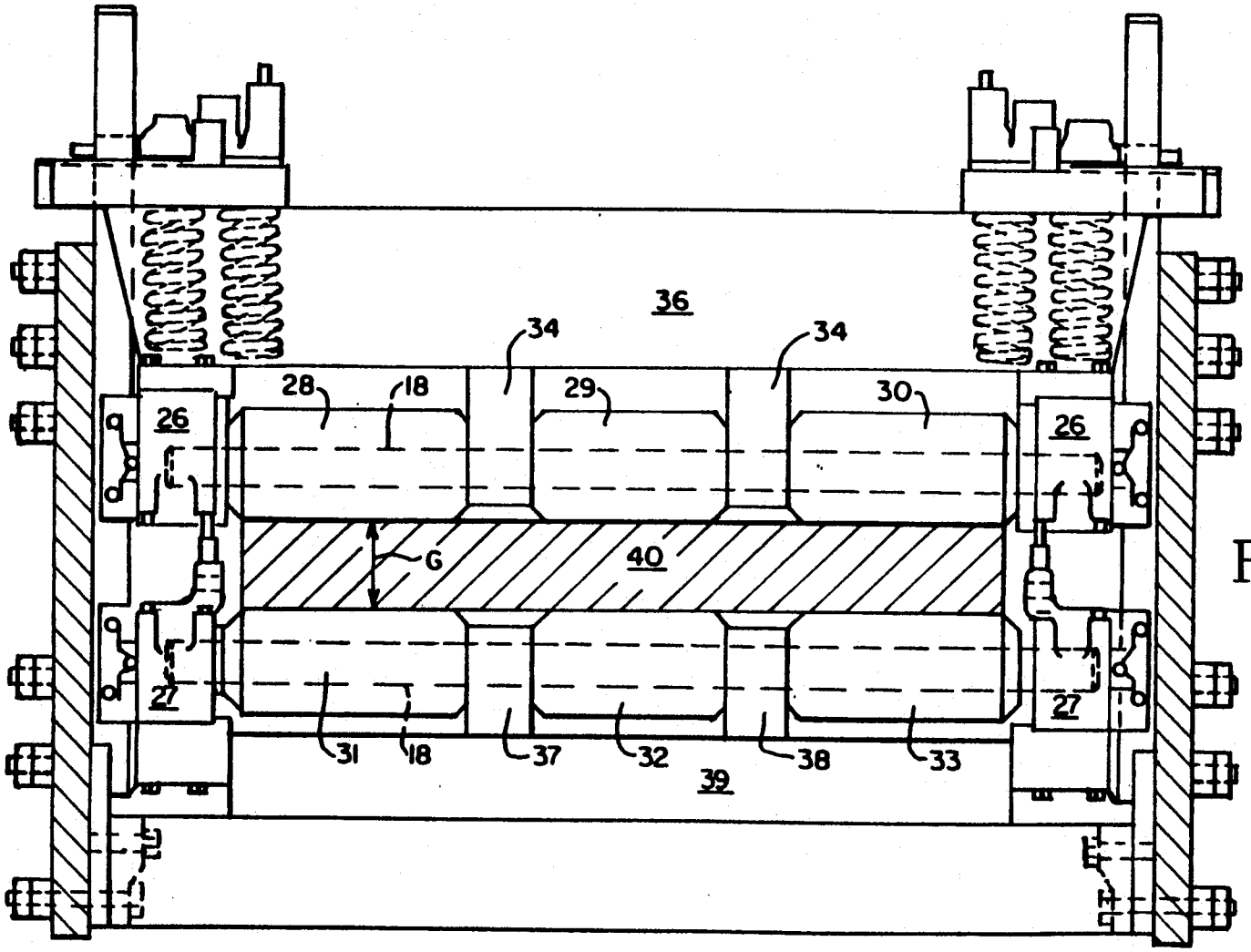
FIG. 2 is an enlarged cross-sectional view of a part of rolls taken on line II—II of FIG. 1.

As shown more particularly in FIG. 2 the rolls are mounted in a frame that includes opposed pairs of similar chocks 26, 27. The upper roll is comprised of a plurality of roll segments 28, 29, 30 and the lower roll is comprised of a similar number of roll segments 31, 32, 33. The upper and lower roll segments are mounted on similar shafts 18 the ends of which are journalled in suitable bearings within the chocks 26, 27. The portions of the shaft 18 between the segments 28, 29, and 29, 30 are reinforced by similar journals 34, which are mounted on a frame member 36. Similarly, the shaft for the lower roll segments 31, 32, 33 are reinforced by journals 37, 38 which are mounted on a frame member 39. The frame members 36, 39 are parts of the rack which include the chocks 26, 27. The upper and lower roll segments are separated by the space of gap "G"through which a workpiece or strand 40 passes through the casting machine.

During operation of the casting machine over a period of time, the roll and bearings wear or become otherwise defective so that the gap "G" between the upper and lower rolls deviates from its original dimension and portions. For that reason, it is necessary from time to time to monitor the gap "G" to determine whether or not a deviation from the preset conditions requires adjustment or replacement of the any roll rack.

Figure 5:
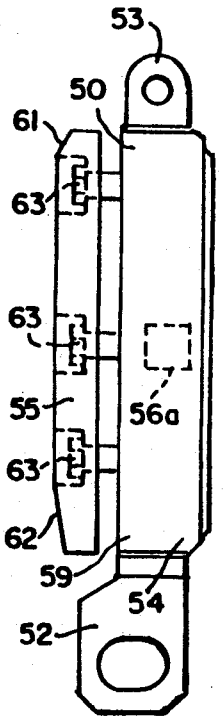
FIG. 5 is a side view taken along line V—V of FIG. 3.
Figure 3:
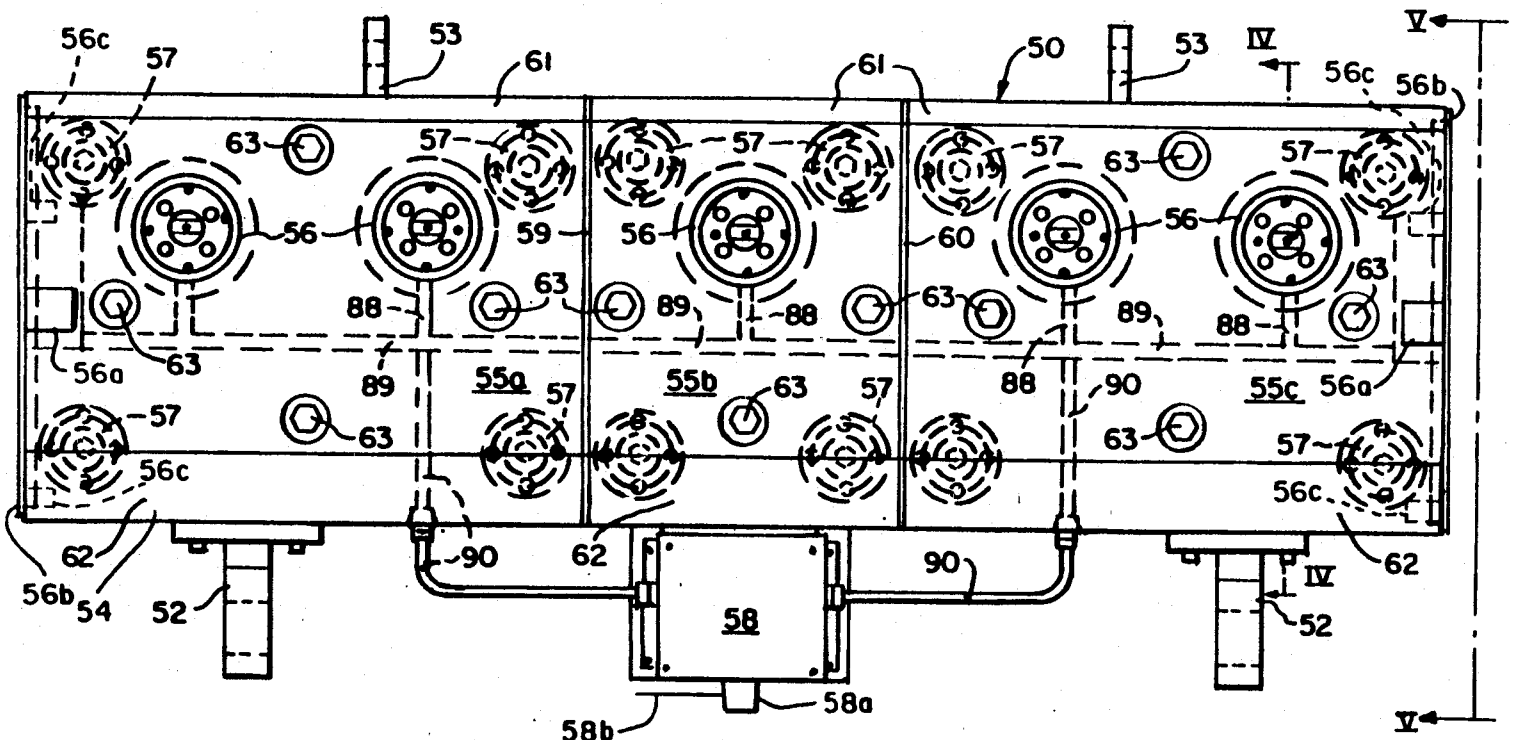
FIG. 3 is a plan view of a roll monitor device used in the invention.

A roll gap monitor 50 (FIG. 1) is provided for movement between the spaced rolls forming the path of travel for the workpiece or strand 40 (FIG. 2). The monitor 50 is detachably mounted on the end of a flexible starter bar 51 by which the monitor is moved from the upper end of the casting machine to the lower end in order to monitor and measure the space or gap between pairs of rolls. For that purpose the monitor 50 includes connecting eyes 52 (FIGS. 3 and 5) by which the monitor 50 is connected to corresponding eyes on the end of the starter bar 51. The monitor also includes lifting eyes 53 by which the monitor may be lifted by suitable means such as a cable, when desirable.

In accordance with this invention, the monitor 50 (FIGS. 3–6) is comprised of a housing 54, a shoe 55, a plurality of gap sensors 56, a plurality of bias members 57, and a sled data processor 58, containing an on-board computer and a radio modem **58*a* with associated antenna 58*b*. The housing 54** generally is a rectangular parallelepiped and is comprised of a metal, such as steel.

The shoe 55 is mounted on the housing 54 and is substantially coextensive with the top side of the housing. More particularly, the shoe is divided into a plurality, such as three sections **55*a*, 55*b*, 55*c*, which are separated from each other at locations 59 and 60. Leading edges 61 of the shoe sections are beveled and rear edges 62 are likewise beveled. The beveled edges 61, 62 facilitate movement of the monitor through the gap "G". The several sections of the shoe 55 are retained in place on the housing 54 by a plurality of retaining bolts 63 which are contained (FIG. 4) within recesses 64 of the shoe. The shaft of each bolt 63 extends through a pair of aligned holes in the shoe and the housing 54 and the bolts are secured in place by nuts 65**.

Figure 4:
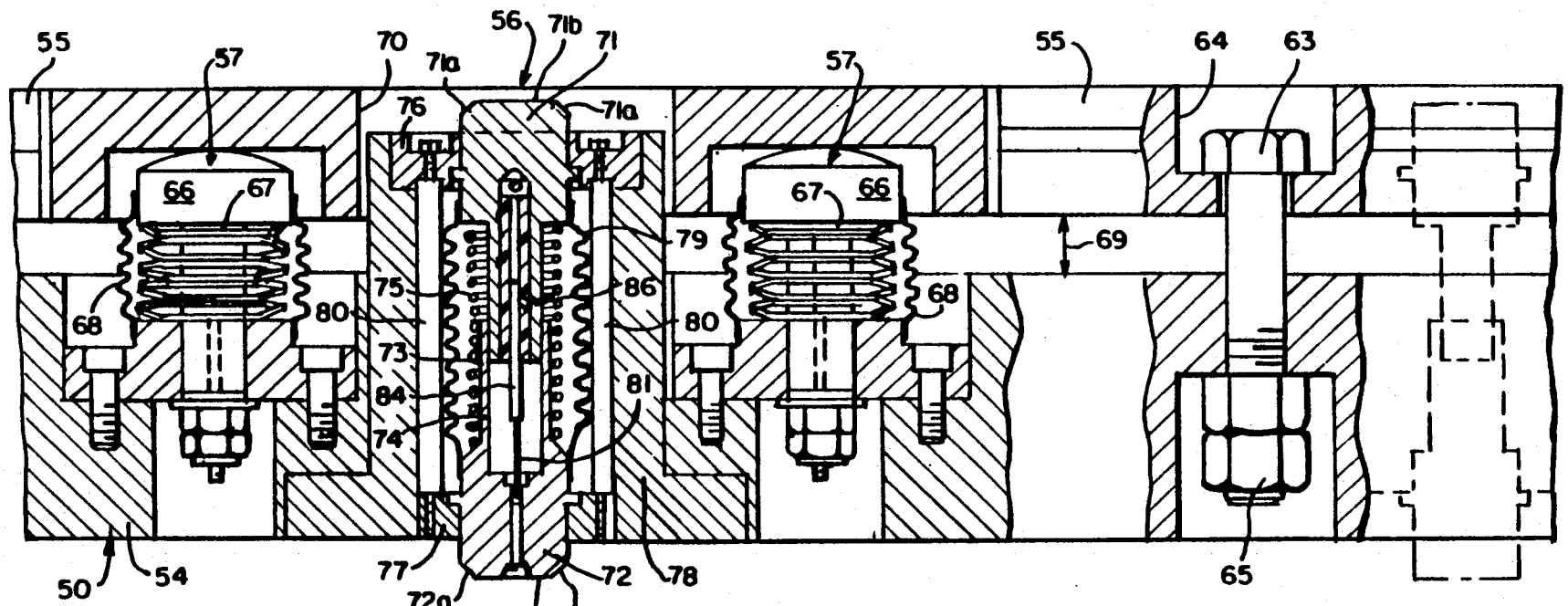
FIG. 4 is a cross-sectional view taken along line IV—IV of FIG. 3.

Bias members 57 are disposed at the four corner portions of each section of the shoe 55 and are comprised of a bolt 66 and spring 67, such as a coil or Belleville spring (FIG. 4). Bellows 68 enclose the assembly of the bolt and spring. Each bias member 57 is mounted in a recess in housing 54 and the bolts 66 are urged outwardly by the springs 67 against the shoes 55 so as to hold the shoe 55 and the housing at a distance indicated by the space 69. The remaining bolts 63 hold the shoe section 55 in place. Accordingly, though the bias members 57 yieldingly retain the shoe sections against the heads of the bolts 63, the springs 67 yield to enable the shoe to move inwardly toward the body of the housing 54.

Gap sensors 56 are fixedly mounted in the housing 54 and extends through and within an opening 70 in the shoe 55. Each sensor comprises a pair of sensing heads 71, 72 which are integral portions of telescopically fitting tubes 73, 74. A coil spring 75 retains the heads 71, 72 in extended positions within a retaining unit including opposite end walls 76, 77 of a tubular housing 73. The assembly of a spring 75 and telescopic tubes 73, 74 is contained within bellows 79. The end walls 76, 77 are secured in place within the ends of the housing 78 by a plurality of the bolts 80 extending between the end walls. The gap sensor 56 is available commercially. The sensing heads 71, 72 are beveled at **71*a*, 72*a* respectively, in the direction of travel through the caster containment to properly engage rolls at the topmost surface 71*b* and bottom most surface 72*b* to accommodate for misalignment or bent rolls. However, the surfaces 71*b* and 72*b*** are sufficiently wide to contact the split roll section or segments.

Also provided are a pair of angle sensors **56*a* located inside the opposite sidewalls of the housing 54. The sensors 56*a* are mounted on separate plates 56*b* which underlie the respective sidewalls of the housing and project from the back wall of the housing. Springs 56*c* are provided which urge the plate 56*b* outwardly. Thus the plates 56*b* serve as additional runners. The angle sensors 56*a*** and their operation are explained in U.S. Pat. No. Re. 30,075, which is expressly incorporated herein by reference.

When the sled 50 moves between an opposite pair of rolls, the head 72 (FIG. 4) is compressed against the coil spring 75, causing the tubes 73, 74 to compress together telescopically. A rod 81 which is mounted at the lower end of the head 72 moves upwardly, whereby a core 84 on the upper end of the rod moves further into a coil 86. Lead wires (not shown) extend from the coil through innerconnecting passages 88, 89, 90 to the sled data processing unit. The data receiving and transmission function will be described below. Similarly, when the shoe 55 is depressed through the space 69 (FIG. 4), the upper head 71 is compressed either alone or simultaneously with the head 72 causing the core 84 to move further into the coil 86 resulting in similar results as described with respect to the head 72.

Accordingly, as the roll gap monitor or sled 50 moves through the caster, spacings between the rolls which are greater or lesser than the prescribed settings therebetween are sensed. The resulting measurements of the spacings and angles are recorded in a suitable manner such as on a computer. All measurements that are out of tolerance are of significance in deciding whether to continue operation, or to repair or replace the particular roll rack involved. The several gap shoes 55 (FIG. 3) are disposed across the shoe sections 55*a*, 55*b* and 55*c* in order to contact all roll segments.

An example of the manner in which monitor 50 is employed to locate a displacement of a roll is shown in FIG. 6. The monitor 50 is shown disposed between pairs of rolls in the casting line, such as upper rolls 92 and lower rolls 93. Due to shifting of a roll to position 92*a* the shoe 55 is inclined at an angle to the housing 54 and the gap sensor 56 is pressed between the rolls 92 and 93 to measure the roll spacing.

Figure 7:
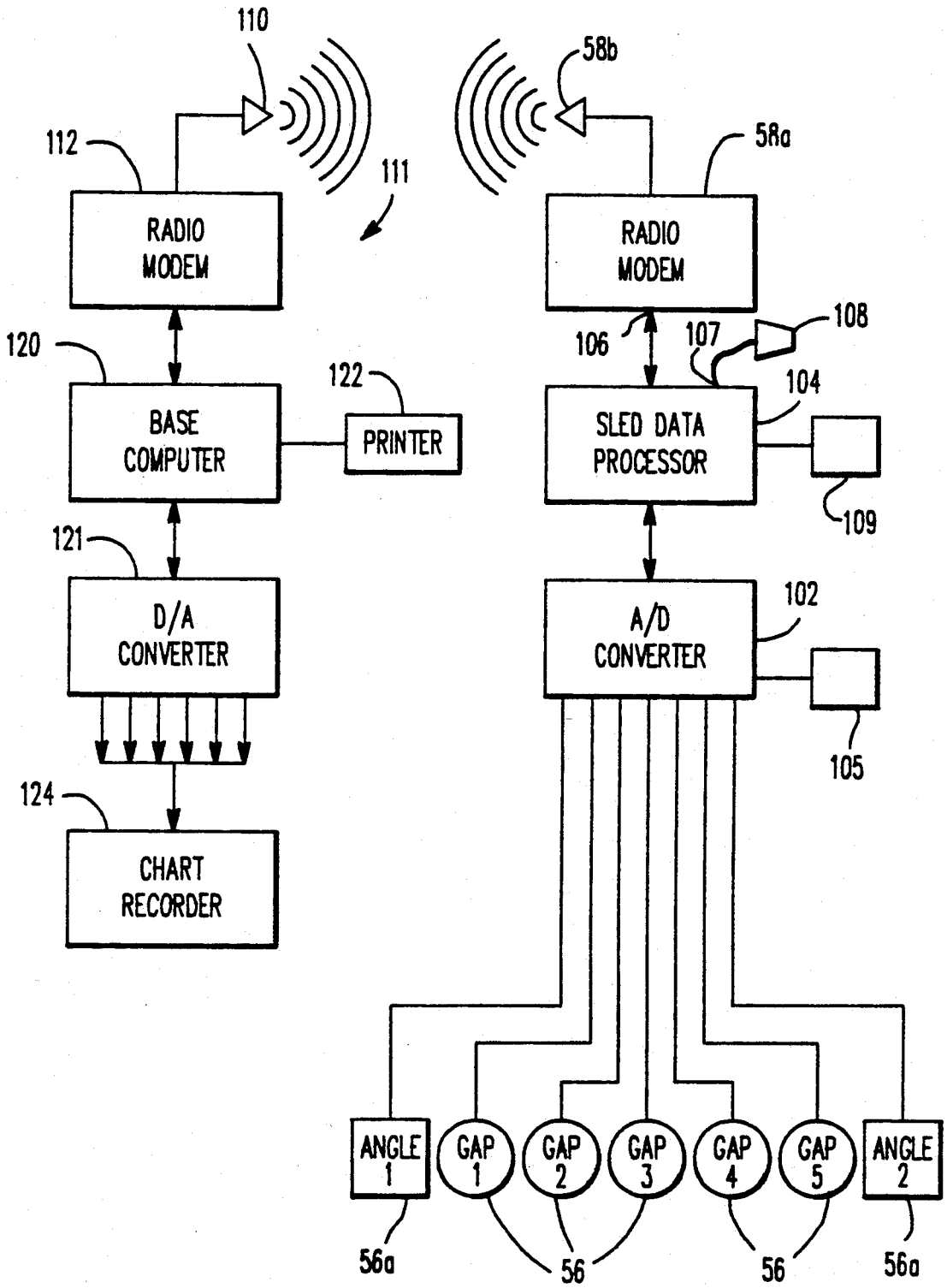
FIG. 7 is a schematic diagram of the system of the invention.

Referring now more particularly to FIG. 7, the data handling system of the invention is shown in schematic diagram. Signals from the gap sensors 56 and angle sensors 56*a* are transmitted to an 8-channel analog to digital converter 102. The A/D converter 102 has a channel for each of the gap sensors 56 (5 channels) and each of the angle sensors 56*a* (2 channels). The eighth channel can be used for a heat sensitive element 105, such as thermocouple or thermistor, to monitor the roll gap monitor's internal operating temperature. It will be appreciated that in the form shown of FIG. 7, an 8-channel system is shown but the invention is not so limited. A/D converter can be multi-channel, and can handle more than 5 channels for more than five gap sensors. There can also be more than 2 channels for the angle sensors. Finally, extra channels can handle other operating parameters besides those handled by, for example, the eighth channel discussed above.

The converted analog to digital signals are then transmitted from the A/D converter 102 to the sled data processor 104. The sled data processor 104 is composed of a small, single-board computer of industrial rating which is IBM compatible and which contains an Intel 80826 microprocessor functioning at 16 MHZ. The sled data processor 104 can be an AMPRO little Board/286 computer with 512 Fb RAM manufactured by Ampro Computer, Inc. of Sunnyvale, Calif.

The sled data processor 104 also includes two on-board serial ports 106 and 107 which are used to operate the radio modem 58*a* and a hand held calibration unit 108. Power to the sled data processor 104 is supplied from a bank of 12 volt gelled-electrolyte lead-acid batteries 109. The batteries 109 having sufficient capacity for at least three hours of continuous usage. The sled data processor 104 has an Intel 27011 program media and is mounted on a Stackplane PC.

The signals passed to the radio modem 58*a* are transmitted through on-board antenna 58*b* and received at antenna 110 on the radio modem 112 of the data display processor 111. The radio modems communicate to their respective processors via a standard RS-232C serial interface. The link functions at a nominal rate of 4800 bits per second (bps) or 480 characters per second.

The data display processor 111 is comprised of an IBM compatible desktop or industrial rack-mount computer system 120 based on the Intel 386SX processor such as an Everex STEP 386SX made by Everex Systems, Inc. of Fremont, Calif. The computer 120 has a base memory of 2 megabytes with a 40 megabyte hard disk and a VGA video display. The software (described below) requires only 640 kilobytes of memory, however the system is provided with a base memory of 2 megabytes in order to facilitate future expansion. Storage of the roll gap monitor display and reporting program as well as the data acquired from the sled data processor is provided by the 40 megabyte fixed disk drive. A single floppy diskette drive is installed for back-up of acquired data.

A voice-output card and speaker are provided for annunciation of real time events. This voice-output card can be a Sound Blaster sound digitizer made by Creative Labs of South San Francisco, Calif.

Signals from the data display processor 120 are transmitted to digital to analog converter 121. The digital to analog converter 121 can be a Metrabyte DDA-06 six channel D/A converter made by Metrabyte Corporation of Taunton, Mass. The analog signal is outputted to a chart recorder 124 and a computer output printer 122 (Model KXP-1124 made by Panasonic).

The software embedded in the sled data processor 104 will now be described. This software is based on a "triggered mode". That is, the sled data processor does not continuously stream along the digitized analog signals to the radio modem 58*a* for transmission to the data display processor 111. A continuous stream of data is not needed because for only about ten percent of the time are the sensors 56 and 56*a* active, i.e., contacting rolls. Thus, the sled data processor 104 only transmits data when the sensors are active. The advantage of the triggering is much greater utilization of available radio band-width and computer memory. In addition, hysteresis is used to completely eliminate noise and transducer jitter as sources of false triggering. This hysteresis effect generates a user-selectable "dead band" in which no triggering or de-triggering may occur.

Figure 8:
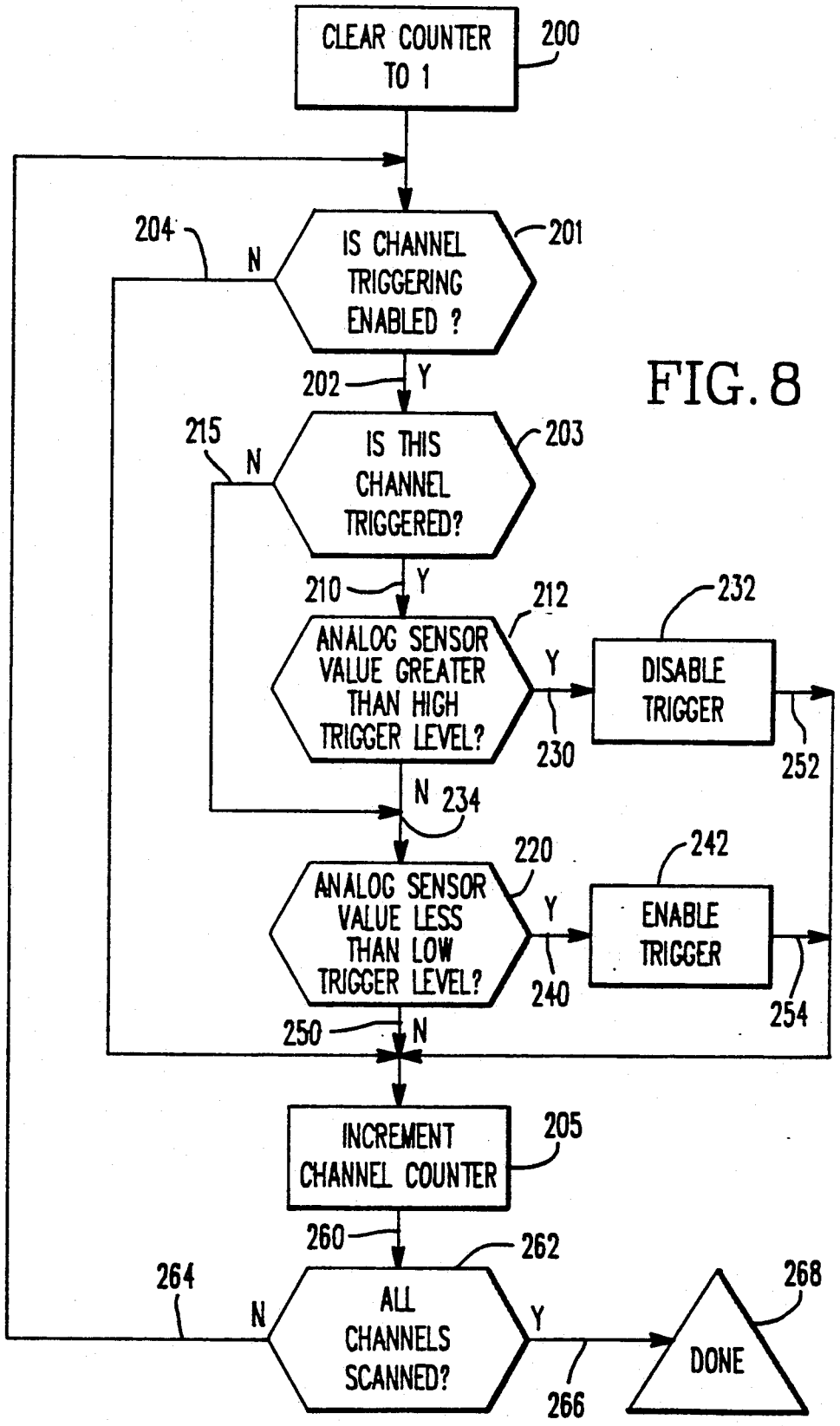
FIG. 8 is a flow chart of the input triggering logic.

The input triggering logic is shown in FIG. 8. The system first starts by setting a counter at 200. After this, there are several decision points. The first decision box asks if the channel is triggered enabled 201. The term "triggered" means that a transducer is depressed, which starts data collection. When a channel is "triggered enabled" it means that the system operator has allowed a channel to be triggerable. Conversely, "triggered disabled"means that the system operator has *not* allowed a channel to be triggered. If the channel is triggered enabled line 202 leads to decision box 203 which asks if the channel is triggered. If the channel is not trigger enabled, line 204 leads to the instruction box increment channel counter 205. At box 203, the system asks if the channel is triggered. If the channel is triggered, line 210 leads to another decision box 212 which asks if the analog sensor value is greater than the high trigger level. If the channel is not triggered, line 215 leads to decision box 220 concerning the low trigger value. This box 220 will be discussed further below.

The high trigger level is set from the main menu screen ("set-up", explained below) which allows entry of a variety of important system configuration data and is typically in the range of about 4.90 to 5 volts. If the analog sensor value is greater than the high trigger level, then line 230 leads to an instruction box 232 that disables the trigger. If the analog sensor value is less than or equal to the high trigger level then line 234 leads to decision box 220 concerning the low trigger level.

Decision box 220 asks if the analog sensor value is less than the low trigger level. The low trigger value is also set from the main menu screen and can range from about 4.9 volts to 5.0. If the analog sensor value is less than the low trigger level, line 240 leads to an instruction box 242 that enables the trigger. If the analog sensor value is greater than or equal to the low trigger level, then line 250 leads the increment channel counter instruction box 205. Lines 252 and 254 from the disable trigger instruction box 232 and the enable trigger instruction box 242 respectively also lead to the increment channel counter instruction box 205.

After the increment counter step, line 260 leads to a decision box 262 asking if all channels have been scanned. If all channels have not been scanned, line 264 leads to the beginning of the program and starts the process over. If all channels have been scanned, line 266 leads to the done box 268 and the program is completed.

The input triggering logic is invoked at regular intervals during the data acquisition mode. It sets or clears an internal flag called "TRIGGER" which is used by other tasks to determine if data acquisition and peak detection should be occurring. The logic is designed so that any channel can be prevented from affecting the trigger status by disabling it. In addition, while only one sensor needs to be activated (i.e., depressed) to start data acquisition, all sensors must be deactivated (i.e., *not* depressed) to disable data acquisition.

Data acquisition can be performed only if the TRIGGER flag is active; i.e., when one or more sensors are active (depressed). Once the system is triggered, data acquisition can take place. An internal buffer capable of storing over one minute's worth of analog signal is used to receive the analog signals. The analog signals are received into the buffer from all seven channels. A pointer is used to keep track of the current position within the analog buffer so that other tasks may access the data in an organized fashion.

The rate at which the data is sampled is user adjustable but is nominally 40 Hz. A feature of the system is that the sample rate can be increased to over three times the nominal sampling rate. This data is stored in the buffer and can be sent by the modem when the roll gap monitor is between roll pairs, i.e., when the sensors are not depressed and thus when the TRIGGER is inactive. This allows the dead time between roll pairs to be used to transmit data concerning the sensors. This allows more comprehensive sampling when the TRIGGER is active thus giving a better picture of the angle and roll gaps.

The system also has a buffer overflow feature. In the prior art roll monitors, if the roll gap monitor was stopped with the sensors depressed, such as by operator or mechanical error, the input triggering logic was continuously triggered. This would overflow the buffers and data would be lost. The system of the invention has a user adjustable timeout feature beyond which data collection stops. The timeout is user set, but is usually about ten seconds. Peak detection (discussed below), is not affected by this feature and thus continues indefinitely until triggering is disabled.

Minimum trigger durations are also set. If the system is triggered and then disabled too soon, the peak information is discarded. This is a back-up to the hysteresis routine. This minimum duration value is also user set (through the main menu screen) but is usually about 0.5 seconds.

Peak detection is also performed by the system. All five sensor 56 channels of the A/D converter 102 are monitored simultaneously for peak values. Whenever a peak is detected on any of the five sensor 56 channels, data values for all sensor 56 channels and angle sensor 56*a* channels are acquired and stored. This system is virtually immune to transducer failure to pick the peaks of the roll gaps since all channels, and not a single channel, are monitored. In addition, this will allow a user to select whatever set of peaks are available when the user desires to have a report on the peaks outputted.

The system has an interrupt timer in order to provide for accurate sampling intervals. At regular intervals, a hardware timer chip on the main board issues an interrupt request to the sled processor 104. Whatever task is in progress at that time is temporarily suspended and a new task, the interrupt handler, is executed. This task performs several functions including updating the clock/calendar, reading and storing the current analog values for all sensors, transmitting and receiving data via modem and checking for peaks. The code for the data acquisition and peak detection is contained within the interrupt handler. When the interrupt handler has completed its functions, the interrupted task continues as if nothing happened.

In order to effectively perform the several functions of the system simultaneously, re-entrant multi-tasking is used. This is not true pre-emptive multi-tasking as commonly seen on main frame computer, but achieves much of the same effect in the end use of the invention.

As was presented above, the sled data processing is constantly performing the following tasks: (1) keeping track of the current time and data; (2) reading the analog converter; (3) transmitting analog data, peak records and status information; (4) receiving and interpreting commands from the sled data processor; (5) checking for the calibration terminal; and (6) checking for peaks. Each of these tasks may consist of several subtasks. Some of these tasks are very simple and fast, such as keeping track of the current date and time, and some of these tasks perform only a small part of their assigned function each time they are invoked. This means that a whole series of tasks or subroutines may be called in succession and will appear to execute simultaneously.

The following program illustrates the above.

```
MAIN LOOP
CALL CheckStart-up
CALL UpdateClock
CALL ReadConverter
CALL Transmitter
CALL CheckTerminal
CALL CheckPeaks
GO TO MAINLOOP
```

This program is constantly executing from within moments after the system is powered on. The interrupt handler (explained above) is running in parallel with the MAINLOOP and handles those tasks which require precise timing.

The data acquired by the on-board processor is sent by radio modem to the host computer in packets. These packets consist of three main components: a header; data; and a trailer. The header contains a code describing the packet type and overall size of the packet. The data is the block of data being transmitted. The trailer contains a "check sum" as is well known to those skilled in the art, for the purpose of error detection. The trailer also includes a terminating character. If a packet is not received properly by the sled data processor modem or the data display processor modem, the packet is immediately retransmitted. Retransmission will occur as many times as necessary to get the information properly received. If there is a major system failure, such as complete blockage, packets will start to line up in the outgoing message queue to be transmitted. This might cause some data loss, although this type of system failure is rare. Reception of the packet is handled in a similar fashion.

Referring back to FIG. 7, the calibration device 108 is plugged into the serial port 107 of the sled data processor 104. The operator can then access the software in the sled data processor to calibrate the five gaps sensor 56 and two angle sensors 56a. After any (or all) of these sensors have been calibrated, the operator can thus transmit this information via radio link to the data display processor 111. This calibration record will be kept in computer memory until the next time a calibration is performed. A feature of the calibration system is that should the operator fail to explicitly transmit the calibration data to the data display processor 111, the act of unplugging the terminal from the serial port 107 will automatically do so.

Figure 9:
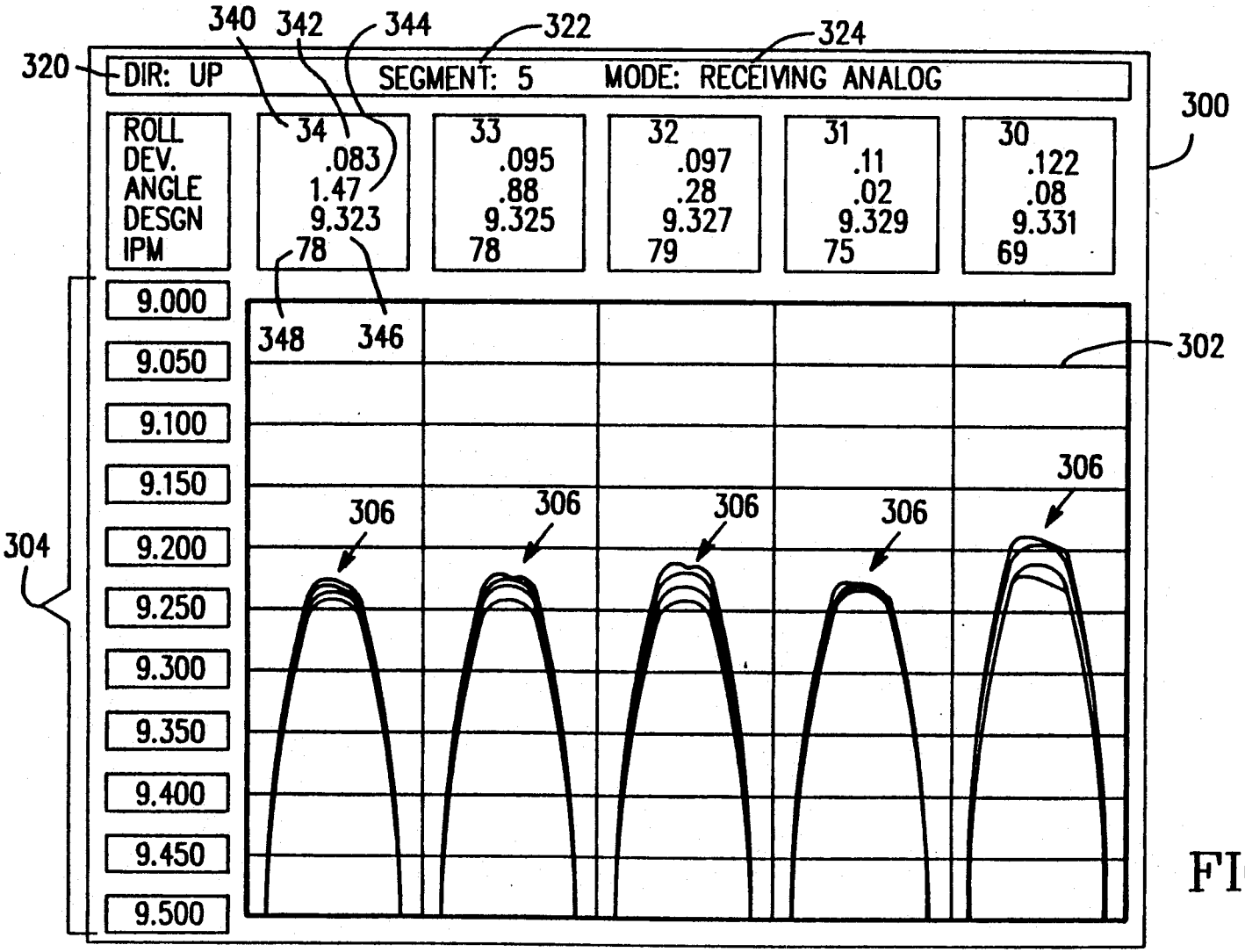
FIG. 9 is a representation of the main screen of the data display.

The data display processor and interface is the CRT on the host computer. As shown in FIG. 9, only one main screen is used, with additional displays and menus appearing within pop-up windows. The main screen 300 has a grid 302 that is divided into gradients of inches to represent the gaps between roll pairs. The y-axis 304 consists of the gap measurements. The waveforms 306 are traced over the grid. There are five separate waveforms, one for each gap sensor. Each separate waveform is traced by a different colored pen. The screen displays a total of five waveforms with the newest waveform appearing at the left of the screen and the oldest waveform being removed from the screen after a new waveform is traced.

Printed on the upper portion of the screen are three system monitoring indicators. The direction of the sled (up or down) is indicated at 320. The segment is indicated at 322. A cast line is divided into several segments with opposing rolls. The segment indicator merely tells the system operator in which segment the sled is positioned. The system mode (e.g., receiving analog) is indicated at 324. Printed directly above the waveform are data concerning the gaps. The first line 340 indicates the roll pair number. The second line 342 indicates the deviation from the design of the roll gap which is determined by taking the difference between the measured gap and the design gap. The third line 344 is the angle measured by one of the angle sensors for the roll pair in which the sled is positioned. The fourth line 346 is the design gap for the particular roll pair, and finally the fifth line 348 is the speed of the roll gap sled monitor through the cast line, measured in inches per minute.

Windows in the main screen 300 (not shown in FIG. 9) are also provided and are involved by pressing menu options or by occurrences in the travel of the roll gap sled monitor. Examples of the windows are: settings (main menu screen); calibration; trigger control; reports; and a help screen.

A printed report module is also provided which can print a number of different reports. The reporting module can generate both text-based and graphical printouts. Graphs can be seen on the screen (FIG. 9) at the same time that they are printed. The reports can include roll center inclinations for each angle sensor; gap deviations for each gap sensor; relative inclination deviation graph or both angle transducers. The system also has an ability to regenerate the chart recording on chart recorder 124 by playing stored data files through the digital to analog converter 121. This replay capability allows the user to make a new chart recording from stored data at any time.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrations only and not limiting as to the scope of the invention which is to be given the full breadth of the appended claims and any and all equivalents thereof.

What is claimed is:

1. A method of monitoring sets of rolls of a continuous casting machine arranged in opposed pairs and having work-engaging faces separated by spaced gaps and defining a path of travel for a workpiece, said method comprising the steps of:

passing a roll monitor sled along said path of travel;

generating analog signals representative of particular measurements of said roll using sensors carried by said roll monitor sled;

converting said analog signals to digitized analog signals;

processing said digitized analog signals with a processor on board said roll monitor sled activated to generate processed digital signals corresponding to analog signals created when said sensors are in contact with said work-engaging faces;

transmitting said processed digital signals from said roll monitor sled;

receiving said processed digital signals transmitted from said roll monitor sled; and processing the received processed digital signals into user accessible form.

2. The method of claim 1, wherein said step of converting said analog signals to digitized analog signals, comprises:

sampling said analog signals at a first data rate, and including storing said processed digital signals in storage means in the processor on board said roll monitor sled, and wherein said transmitting step comprises transmitting said processed digital signals at a second data rate which is lower than said first data rate, whereby a portion of said processed digital signals will be stored when said sensors are in contact with said work engaging faces for subsequent transmission.

3. The method of claim 1 wherein said step of processing said digitized analog signals includes detecting the peaks of the digitized analog signals to generate peak digital signals, and wherein said step of transmitting includes transmitting the processed digital signals generated by each of the plurality of sensors when a peak is detected in any one of the said processed digital signals from said sensors.

4. The method of claim 2 wherein said step of transmitting comprises transmitting packets of data consisting of a header, data, and a trailer, said trailer being a check sum for said data package.

5. The method of claim 1 including calibrating said sensors with means adapted to be plugged into said processor on board said roll monitor sled.

6. The method of claim 1 wherein said step of processing the received processed digital signals includes generating a main display screen of waveform tracings related to gaps measured by said sensors.

7. The method of claim 6 wherein said step of processing the processed digital signals received from said roll sled monitor includes reconverting said processed digital signals into analog signals and generating a representation of the analog signals created when the sensors are in contact with the work-engaging faces.

8. The method of claim 1 wherein said step of processing said digitized analog signals with a processor on board said roll monitor sled includes ceasing acquisition of data when said sensors are triggered for more than a predetermined time period.

9. The method of claim 7 wherein said step of reconverting includes printing out waveforms related to the dimensions of the rolls.

10. A method of monitoring sets of rolls of a continuous casting machine arranged in opposed pairs and having work-engaging faces separated by spaced gaps and defining a path of travel for a workpiece, said method comprising passing a roll monitor sled along said path of travel;

generating analog signals representative of particular measurements of said rolls by sensors carried by the roll monitor sled which contacts said work-engaging faces;

converting said analog signals to digital signals;

processing said digital signals on board said roll monitor sled to generate peak digital signals representative of the peaks of said digital signals;

transmitting the digital signals and the peak digital signals; and receiving the transmitted digital signals and peak digital signals outside of said continuous casting machine; and processing the transmitted digital signals and peak digital signals into a user accessible form.

* * * * *